United States Patent [19]

Gross et al.

[11] Patent Number: 4,825,867

[45] Date of Patent: May 2, 1989

[54] DEPILATORY DEVICE FOR REMOVING HAIR

[75] Inventors: Joseph Gross, Moshav Mazor; David Lowenstein, Natanya; Menahem Tilman, Hofit; Etan Rosenberg, Kiryat Ono, all of Israel

[73] Assignee: Hair Remover Ltd., Tel Aviv, Israel

[21] Appl. No.: 163,047

[22] Filed: Mar. 2, 1988

[30] Foreign Application Priority Data

Mar. 4, 1987 [IL] Israel ..... 81780

[51] Int. Cl.[4] ..... A61B 17/00

[52] U.S. Cl. ..... 128/355; 17/11.1 R

[58] Field of Search ..... 128/354, 355; 17/11.1, 17/47

[56] References Cited

U.S. PATENT DOCUMENTS

| | | | |
|---|---|---|---|
| 2,900,661 | 8/1959 | Schnell | 128/355 X |
| 4,079,741 | 3/1978 | Daar et al. | 128/355 |
| 4,279,253 | 7/1981 | Haes et al. | 128/355 |
| 4,524,772 | 6/1985 | Daar et al. | 128/355 |
| 4,726,375 | 2/1988 | Gross et al. | 128/355 |

FOREIGN PATENT DOCUMENTS

| | | | |
|---|---|---|---|
| 147285 | 7/1985 | European Pat. Off. | 128/355 |

*Primary Examiner*—Dalton L. Truluck

*Attorney, Agent, or Firm*—Benjamin J. Barish

[57] ABSTRACT

A device for removing body hair comprises a manually-grippable housing, and a hair-plucker body rotatably mounted to the housing and having an exposed section formed with a plurality of gaps in its outer surface which open and close during the rotation of the hair-plucker body to receive, pluck and eject body hair growing on a surface over which the hair-plucker body is moved. The hair-plucker body includes a pair of drums mounted in spaced parallel relationship, and a belt enclosing the drums and engaging their outer surfaces so as to be rotated thereby. The belt is formed with a plurality of gaps extending circumferentially of the belt. One of the drums is configured so as to cause the portion of the belt engaging it to open its gaps, and the other drum is configured so as to cause the portion of the belt engaging it to close its gaps.

15 Claims, 1 Drawing Sheet

FIG 1
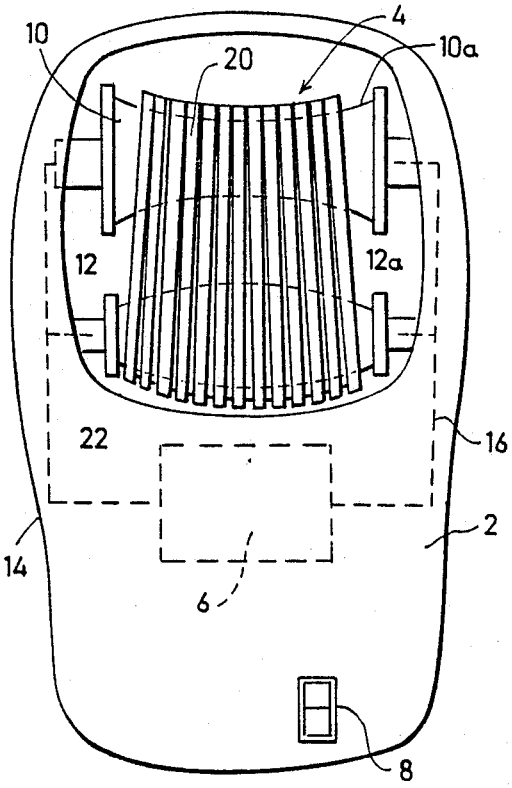
FIG 2
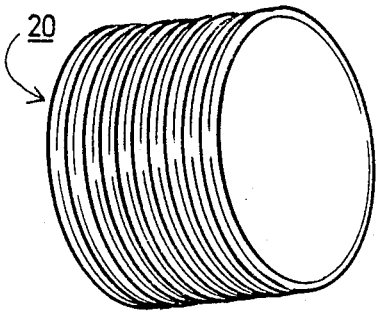
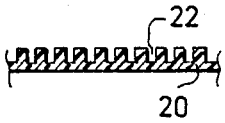
FIG 3
FIG 4
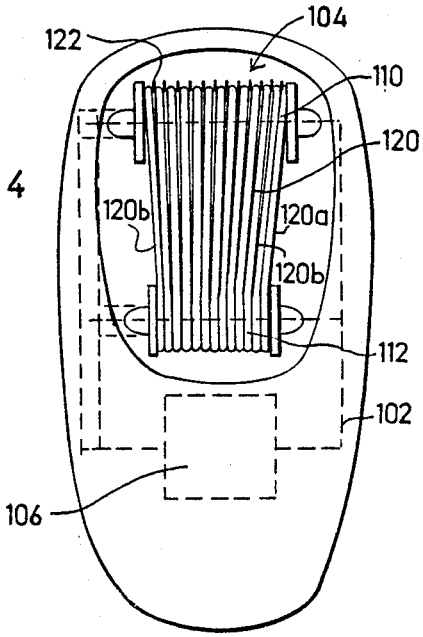
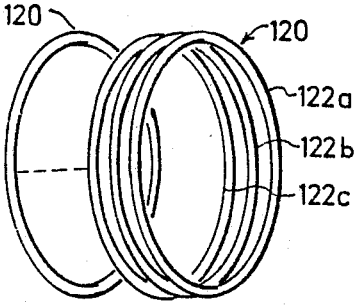
FIG 5

DEPILATORY DEVICE FOR REMOVING HAIR

RELATED APPLICATIONS

The present application is related to our application Ser. No. 07/031,760 filed Mar. 30, 1987, now U.S. Pat. No. 4,726,375 of Feb. 23, 1988, and also to our copending application Ser. No. 163,356, filed Mar. 2, 1988, both assigned to the same assignee as the present application.

BACKGROUND OF THE INVENTION

The present invention relates to depilatory devices for removing body hair such as are used for cosmetic purposes.

A number of depilatory devices for this purpose have been proposed in the past. Some devices include discs to provide gaps of wedge-like configuration for catching and plucking the hair; a device of this type is illustrated by U.S. Pat. No. 2,900,661. Other devices include helical springs which provide gaps between their windings for catching and plucking the hair; examples of this latter device including helical springs are described in U.S. Pat. Nos. 1,232,617, 4,079,741 and 4,524,772, the first two being axial helical springs, and the latter an arcuate spring.

BRIEF SUMMARY OF THE INVENTION

An object of the present invention is to provide a novel depilatory device which uses neither discs nor helical springs.

According to the present invention, there is provided a depilatory device for removing body hair comprising a manually-grippable housing, and a hair-plucker body rotatably mounted to the housing and having an exposed section formed with a plurality of gaps in its outer surface which open and close during the rotation of the hair-plucker body to receive, pluck and eject body hair growing on a surface over which the hair-plucker body is moved; characterized in that the hair-plucker body includes a pair of drums mounted in spaced parallel relationship, and belt means defining a belt enclosing the pair of drums and engaging their outer surfaces so as to be rotated thereby; the belt means being formed with a plurality of gaps extending circumferentially of the belt; one of the drums being configured so as to cause the portion of the belt means engaging same to open its gaps, and the other of the drums being configured so as to cause the portion of the belt means engaging same to close its gaps.

Two embodiments of the invention are described below for purposes of example. In one embodiment, the belt means comprises a single belt formed with a plurality of recesses extending circumferentially of the belt and defining the circumferential gaps, the one drum being formed with an outer convex surface to cause the portion of the belt engaging same to open the gaps, the other drum being formed with an outer concave surface to cause the portion of the belt engaging same to close the gaps.

In a second described embodiment, the belt means is a belt split into a plurality of thin sections wound over the two drums in side-by-side relationship, the space between the belt sections constituting the gaps extending circumferentially of the belt means, one of the drums being longer than the other drum so as to cause the portion of the belt sections engaging same to open the gaps while the other drum causes the portion of the belt sections engaging same to close the gaps.

It will thus be seen that the invention provides a portable hand-operated depilatory device which may be conveniently used for removing body hair.

Further features and advantages of the invention will be apparent from the description below.

BRIEF DESCRIPTION OF THE DRAWINGS

The invention is herein described, by way of example only, with reference to the accompanying drawings, wherein:

FIG. 1 illustrates one form of depilatory device constructed in accordance with the present invention;

FIG. 2 is a three-dimensional view illustrating the belt used in the device of FIG. 1;

FIG. 3 is a sectional view along lines III—III of FIG. 2, better illustrating the structure of the belt;

FIG. 4 illustrates a second embodiment of the invention using a plurality of belt sections; and FIG. 5 illustrates the plurality of belt sections used in the device of FIG. 4.

DESCRIPTION OF PREFERRED EMBODIMENTS

The depilatory device illustrated in FIG. 1 comprises a housing 2 and a hair-plucker body, generally designed 4, rotatably mounted to the housing and having an exposed section for engagement with the user's skin in order to catch, pluck and eject body hairs growing on the skin over which the device is moved. The hair-plucker body 4 is driven by an electric motor, schematically indicated at 6, disposed within the housing. The motor is energized and de-energized by an electric switch 8 carried by the housing.

The hair-plucker body 4 comprises two drums, 10 and 12, in spaced parallel relationship. Both drums are rotated at the same speed by electric motor 6 via any suitable transmission, schematically shown at 14 and 16 in FIG. 1.

Drum 10 is formed with an outer concave surface, as shown at 10*a;* whereas drum 12 is formed with an outer convex surface, as shown at 12*a.* A belt, generally designated 20, encloses both drums and engages their outer surfaces so as to be rotated by the drums. Belt 20 is formed with a plurality of recesses 22 (see FIG. 3) on its outer face so as to be exposed for contact with the skin bearing the hair to be removed. These recesses 22 define a plurality of gaps extending circumferentially of the band.

The device illustrated in FIGS. 1–3 operates as follows:

When the electric motor 6 is energized, both drums 10, 12 are rotated about their axes, which thereby causes belt 20 also to rotate on the drums. The portion of belt 20 engaging drum 12 will be expanded because of the convex outer surface 12*a* of drum 12; whereas the portion of the belt 20 engaging drum 10 will be contracted because of the concave outer surface 10*a* of drum 10. The expansion of belt 20 by the convex surface of drum 12 opens the recesses 22 in the portion of the belt in contact with drum 12 thereby enabling the recess to receive the hairs to be removed as the device is moved over and in contact with the skin. As belt 20 rotates, the recesses 22 automatically close as they approach the concave drum 10, being fully closed at the portion of the belt at the drum 10 end. The closing of the recesses thereby causes the hairs received within them to be plucked from the skin. As the belt continues to rotate to open these recesses, the plucked hairs are ejected from the belt.

FIG. 4 illustrates a second embodiment of the invention, also including a manually-grippable housing 102 and a hair-plucker body, generally designated 104, rotated by an electric motor 106 within the housing under the control of an electric switch 108. The hair-plucker body 104 also includes two drums 110 and 112. However, in this case both drums 110, 112 are of conventional cylindrical configuration, but are of different lengths. Thus, drum 110 is longer than drum 112, as clearly seen in FIG. 4.

The device of FIG. 4 also includes belt means, generally designated 120, enclosing the pair of drums 110, 112 and engaging their outer surfaces so as to be rotated by the drums. In this case, however, belt means 104 is split into a plurality of thin belt sections, **120*a*–120*k*, all wound over the two drums 110, 112 in side-by-side relationship. The cumulative width of all the belt sections 120*a*–120*k* is substantially equal to the length of the smaller-sized drum 112**, so that when all the belt sections are wound on that drum all the belt sections are in firm abutting contact with each other; that is, there is no space or gap between adjacent belts.

The longer drum 110 is formed with a plurality of guides 122, one for each of the belt sections **120*a*–120*k*, for spacing the belt sections. There is thus produced an opening or gap between adjacent belt sections when wound on the larger drum 110**.

It will thus be seen that when the two drums 110 and 112 are rotated by electric motor 106, the upper drum 110, and particularly the guides 122 carried by it, will maintain the belt sections **120*a*–120*k* spaced from each other, thereby producing openings or gaps between adjacent surfaces of the belt sections. These openings or gaps are adapted to receive the body hair when the device is moved over the user's skin bearing hair to be removed. As the belt sections 120*a*–120*k* are rotated towards the smaller drum 112, the latter drum presses them together and closes these openings or gaps, thereby plucking the hair from the user's skin. The so-plucked hair is ejected as the belt sections continue to rotate towards the longer drum 110 which spreads the belt sections because of its longer length and to its guides 122**.

While the invention has been described with respect to depilatory devices for removing body hair, it will be appreciated the invention could also be used for other purposes, e.g. removing chicken feathers. Many other variations, modifications and applications of the invention will be apparent.

What is claimed is:

1. A device for removing body hair comprising a manually-grippable housing, and a hair-plucker body rotatably mounted to the housing and having an exposed section formed with a plurality of gaps in its outer surface which open and close during the rotation of the hair-plucker body to receive, pluck and eject body hair growing on a surface over which the hair-plucker body is moved; characterized in that said hair-plucker body includes a pair of drums mounted in spaced parallel relationship, and belt means defining a belt enclosing said pair of drums and engaging their outer surfaces so as to be rotated thereby; said belt means being formed with a plurality of gaps extending circumferentially of the belt; one of said drums being configured so as to cause the portion of the belt means engaging same to open its gaps, and the other of said drums being configured so as to cause the portion of the belt means engaging same to close its gaps.

2. The device according to claim 1, wherein said belt means comprises a single belt formed with a plurality of recesses extending circumferentially of the belt and defining said circumferential gaps; said one drum being formed with an outer convex surface to cause the portion of the belt engaging same to open said gaps, said other drum being formed with an outer concave surface to cause the portion of the belt engaging same to close said gaps.

3. The device according to claim 2, wherein said recesses are of rectangular configuration.

4. The device according to claim 2, wherein said single belt is of plastic material.

5. The device according to claim 1, wherein said belt means comprises a belt split into a plurality of thin sections wound over the two drums in side-by-side relationship, the spaces between said belt sections constituting said gaps extending circumferentially of the belt means, one of said drums being longer than the other drum so as to cause the portion of the belt sections engaging same to open the gaps while said other drum causes the portion of the belt sections engaging same to close the gaps.

6. The device according to claim 5, wherein said one drum includes spacer elements for spacing apart the belt sections engaging same to open said gaps.

7. The device according to claim 5, wherein said belt sections are of plastic material.

8. The device according to claim 1, further including an electric motor disposed within said housing, and a switch carried by the housing for energizing and de-energizing the electric motor.

9. A device for removing body hair comprising a manually-grippable housing, and a hair-plucker body rotatably mounted to the housing and having an exposed section formed with a plurality of gaps in its outer surface which open and close during the rotation of the hair-plucker body to receive, pluck and eject body hair growing on a surface over which the hair-plucker body is moved; said hair-plucker body including a pair of drums mounted in spaced parallel relationship, and belt means defining a belt enclosing said pair of drums and engaging their outer surfaces so as to be rotated thereby; said belt means comprising a single belt formed with a plurality of recesses extending circumferentially of the belt and defining a plurality of circumferential gaps; one of said drums being formed with an outer convex surface to cause the portion of the belt engaging same to open said gaps, the other of said drums being formed with an outer concave surface to cause the portion of the belt engaging same to close said gaps.

10. The device according to claim 9, wherein said recesses are of rectangular configuration.

11. The device according to claim 9, wherein said single belt is of plastic material.

12. A device for removing body hair comprising a manually-grippable housing, and a hair-plucker body rotatably mounted to the housing and having an exposed section formed with a plurality of gaps in its outer surface which open and close during the rotation of the hair-plucker body to receive, pluck and eject body hair growing on a surface over which the hair-plucker body is moved; said hair-plucker body including a pair of drums mounted in spaced parallel relationship, and belt means defining a belt enclosing said pair of drums and engaging their outer surfaces so as to be rotated thereby; said belt said belt means comprising a belt split into a plurality of thin sections wound over the two drums in side-by-side relationship, the spaces between said belt sections constituting a plurality of gaps extending circumferentially of the belt means, one of said drums being longer than the other drum so as to cause the portion of the belt sections engaging same to open the gaps while said other drum causes the portion of the belt sections engaging same to close the gaps.

13. The device according to claim 12, wherein said one drum includes spacer elements for spacing apart the belt sections engaging same to open said gaps.

14. The device according to claim 12, wherein said belt sections are of plastic material.

15. The device according to claim 12, further including an electric motor disposed within said housing, and a switch carried by the housing for energizing and de-energizing the electric motor.

* * * * *